United States Patent [19]

Ripley

[11] 4,120,149

[45] Oct. 17, 1978

[54] ELECTRONIC WATCH

[75] Inventor: Richard Edward Ripley, Attleboro, Mass.

[73] Assignee: Textron, Inc., Providence, R.I.

[21] Appl. No.: 776,710

[22] Filed: Mar. 11, 1977

[51] Int. Cl.[2] ..... G04B 37/00

[52] U.S. Cl. ..... 58/88 R; 58/91; 58/50 R

[58] Field of Search ..... 58/33, 50 R, 88 R, 88 B, 58/90 R, 90 B, 91, 101

[56] References Cited

U.S. PATENT DOCUMENTS

| | | | |
|---|---|---|---|
| 2,989,838 | 6/1961 | Guggi | 58/90 R |
| 3,757,512 | 9/1973 | Zellweger | 58/90 B |
| 3,838,568 | 10/1974 | Zurcher | 58/50 R |
| 4,004,410 | 1/1977 | Kawamata | 58/90 R |
| 4,059,957 | 11/1977 | Monnet | 58/90 R |

*Primary Examiner*—Robert K. Schaefer
*Assistant Examiner*—William L. Feeney
*Attorney, Agent, or Firm*—Robert L. Thompson

[57] ABSTRACT

An electronic watch which is both thin and water resistant. The watch comprises a back, a bezel and an electronically controlled module for digitally displaying a time signal. Its crystal includes an upper member the lower surface of which is adjacent to the upper surface of the module, a first flange extending downwardly from the edge of the upper member adjacent to the side of the module and a second flange which extends laterally outwardly from the bottom of the first flange. Contact means is provided which has a longitudinal portion sealed into the first flange and an inner end which is electrically connected to the module. A plunger is mounted for axial movement in a bore in the bezel and its inner end is engageable with the contact means. A sealing member is positioned between the second flange of the crystal and an upper surface of the back. It also includes means for holding the upper surface of the back against the sealing member.

6 Claims, 7 Drawing Figures

ELECTRONIC WATCH

BACKGROUND OF THE INVENTION

This invention relates to an electronic watch which is both thin and water resistant. An electronic watch customarily includes an electronically controlled module for digitally displaying a time signal to indicate the time of day. It also includes a plunger which functions as a switch which in one position closes a circuit in which the time is displayed in hours and minutes. The outer end of the plunger is exposed so it may be actuated by the wearer of the watch to close or open the circuit.

There has been a long-felt, recognized need to provide an electronic watch which is both thin and water resistant.

One prior art suggestion to provide a water resistant water is disclosed in U.S. Pat. No. 2,830,434 dated Apr. 15, 1958 to Trautz. The Trautz watch is not an electronic watch, instead it is of the stem wind type. It includes a watch movement holder 12 which is detachably secured to the frame 48 by a ridge 34 which snaps into a slot 62 in the frame. The stem of the watch movement (not shown) passes outwardly through the tube 30 of the movement holder.

The watch case also includes a shell 46 which telescopically receives the frame 48. The frame is provided with a flange 60 and the shell is provided with a flange 74 which has a downwardly extending skirt 80. The frame and shell are secured together by solder 85 which is placed between the lower end of the skirt and the upper surface of the flange 60. The crystal is made of a transparent synthetic resin and it consists of a thick upper member 36, the lower surface of which is spaced a substantial distance above the watch movement holder. The crystal also includes a first flange 38 which extends downwardly from the upper member and a second flange 42 which extends laterally outwardly from the bottom of the first flange. Both the first and second flanges are located above the watch movement and such positioning of these flanges together with the upward spacing of the upper member 36 relative to the watch movement results in a very thick watch as shown in FIG. 6.

The O-ring 18 is compressed between the upper edge of the watch movement holder, the end of the second flange 42 and the frame 48 in an attempt to provide a water-resistant watch case but no water-resistant sealing means is disclosed for the stem of the watch.

The Trautz watch case would be expensive to manufacture and assemble.

U.S. Pat. No. 3,838,568 dated Oct. 1, 1974 to Zurcher discloses an electronic watch in which the sealing ring 34 is positioned between a flange of the back 32 and the bezel 12 and is held against the bezel by the exteriorly threaded locking ring 26. The substrate 56 is urged against the sealing ring 54 by the springs 112 and 114 thereby urging the sealing ring 34 against the periphery of the dial plate 48. The crystal 16 is seated in the bezel 14 and it does not include any downwardly extending or laterally extending flanges.

The push button 146 has a shank 144 which extends through a bore in the bezel and it is normally urged outwardly by a coil spring. When it is depressed, its end 150 contacts a leg 148 of the spring 132 thereby causing electric changes in the electronic circuit and a digital display of a time or other signal.

No water-resistant seal is disclosed between the contact end of the push button and the substrate.

Zurcher lacks a contact means having a longitudinal portion sealed into a flange of his crystal.

The Zurcher watch is very thick and it is not water resistant.

The two above-mentioned patents are the closest prior art of which I am aware.

BRIEF SUMMARY OF THE INVENTION

One object of this invention is to provide a new and improved electronic watch.

Another object is to provide an electronic watch which is both thin and water resistant.

A further object is to provide such a watch which is economical to manufacture.

A still further object is to provide such a watch which may be made in various shapes such as generally circular, rectangular, oblong or the like.

Further objects and advantages of the invention will be apparent to persons skilled in the art from the following description taken in conjunction with the accompanying drawings.

In general, an electronic watch embodying this invention includes a back, a bezel and an electronically controlled module for digitally displaying a time signal. In addition, it includes a crystal which comprises an upper member with its lower surface adjacent to the upper surface of the module, a first flange extending downwardly from the edge of the upper member adjacent to the side of the module and a second flange extending laterally outwardly from the bottom of the first flange.

It also includes contact means which has a longitudinal portion sealed into the first flange and an inner end portion which is electrically connected to the module.

There is a plunger mounted in a bore in the bezel for axial movement therein so that the inner end portion of the plunger is engageable with the outer end of the contact means and the outer end portion of the plunger is exposed for receiving pressure by the user to cause such engagement to occur.

It also includes a sealing member positioned between the second flange and an upper surface of the back and means for holding the upper surface of the back against the sealing member and the sealing member against the second flange.

In a preferred embodiment, the plunger includes a compression spring which normally urges the inner end portion of the plunger out of engagement with the contact means.

In another preferred embodiment, the sealing member is a gasket seal.

In one embodiment, the means for holding the back against the gasket seal includes screw threads on the outer edge of the back and screw threads on an inner portion of the bezel.

In another embodiment, the means for holding the back against the sealing member includes a snap fit between at least one portion of the outer edge of the back and the inner portion of the bezel.

It will be apparent to persons skilled in the art that electronic watches embodying this invention have solved the above-described, recognized long-felt need and satisfied the above-stated objects.

DETAILED DESCRIPTION OF THE FIRST EMBODIMENT

Figure 1:
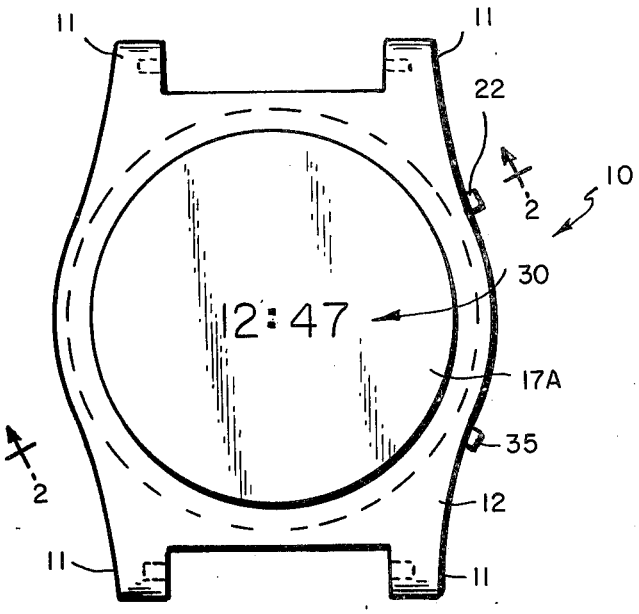
FIG. 1 is a top plan view of the first embodiment of an electronic watch embodying the invention.

The electronic watch 10 of FIGS. 1 to 4 comprises lugs 11 to receive the ends of a watch band.

The bezel 12 is made of electrically conductive material which may be stainless steel or gold-plated brass.

The back 13 is also made of electrically conductive material which may also be made of stainless steel or gold-plated brass. The periphery of the back is circular and is provided with screw threads 13A which are engageable with the threads 12A of the bezel to detachably secure the bezel and the back together.

The electronically controlled module 14 comprises batteries 15 and the customary circuits for digitally displaying a time signal 30. The spring 16 forms an electrical contact between the batteries and the back 13.

Figure 2:
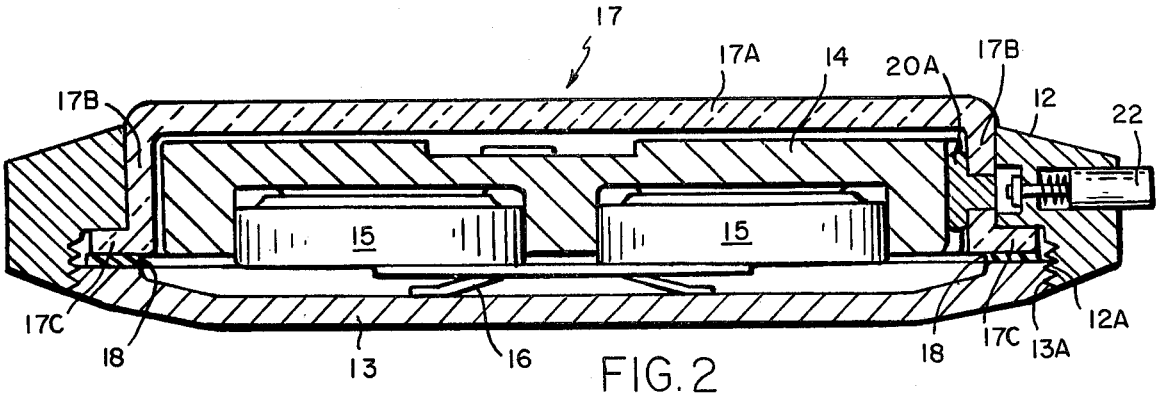
FIG. 2 is an enlarged section taken on the lines 2—2 of FIG. 1.
Figure 3:
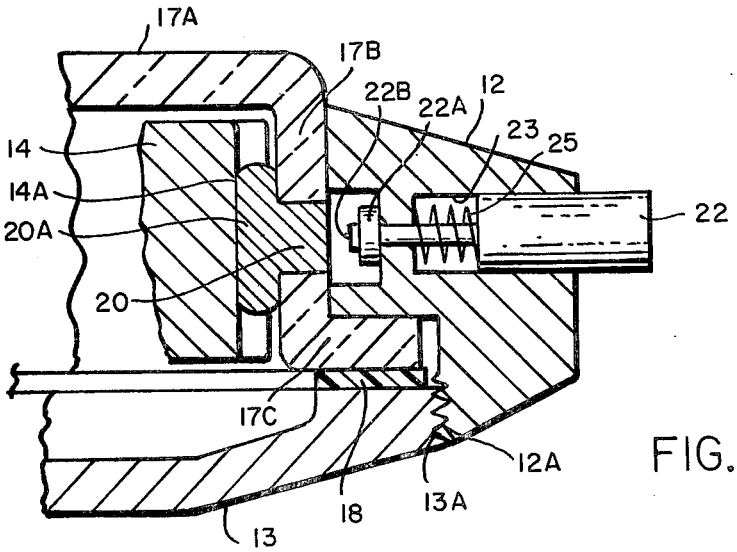
FIG. 3 is a further enlarged section showing the righthand portion of FIG. 2.
Figure 4:
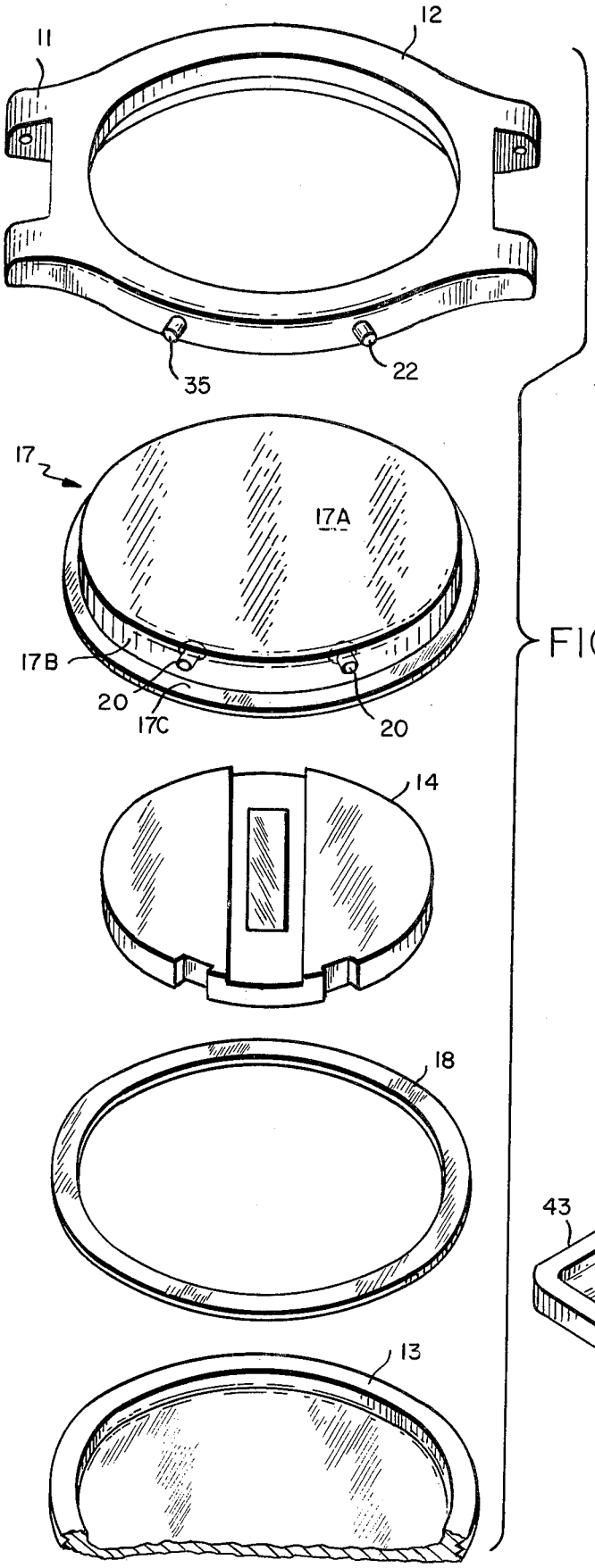
FIG. 4 is an exploded view of the elements of the watch.

The crystal indicated generally by the numeral 17 is made of non-conductive material such as plastic or glass. It comprises an upper member 17A through which the time signal 30 is displayed. The lower surface of this upper member is adjacent to the upper surface of the module as shown in FIGS. 2 and 3. The crystal also comprises a first flange 17B which extends downwardly from the edge of the upper member adjacent to the side of the module and a second flange 17C which extends laterally outwardly from the bottom of the first flange.

The gasket seal 18 is positioned between the second flange 17C and the back and it is held against the second flange by the screw threads 12A and 13A to provide a water-resistant seal between the back and the flange.

The contact means 20 comprises a pin having a cylindrical shank and a head 20A. It is made of electrically conductive material such as brass or stainless steel. Its shank extends through an orifice in the first flange 17B of the crystal and is sealed to it by a compatible cement. The head 20A of the contact pin is in continuous contact with the module contact 14A. It is to be noted that because the shank of the contact pin is sealed in the orifice in the first flange, because the second flange is in tight contact with the gasket seal, and because the gasket seal is in tight contact with the back, the module 14, batteries 15, spring contact 16 and contact head 20A are protected from outside water and moisture.

The cylindrical plunger 22 is slideable longitudinally of the bore 23 of the bezel. It has a head 22A and an end contact portion 22B. The plunger is made of an electrically conductive material such as stainless steel or brass plated to match the bezel. The plunger is normally urged outwardly to the position shown in FIG. 3 by the coil spring 25.

When the plunger is depressed, its end 22B touches the outer end of the shank of the contact means 20 and this closes an electrically conductive path from the module contact 14A through the contact pin 20, the plunger 22 and spring 25 to the bezel 12, back 13, spring 16 and batteries 15, thus energizing the time signal 30.

The plunger 35 (FIG. 1) functions in the same manner as the plunger 22 but it may be used to close an electrically conductive path which energizes a different signal, for example, a day of the week and/or a date of the month signal.

DETAILED DESCRIPTION OF THE SECOND EMBODIMENT

Figure 5:
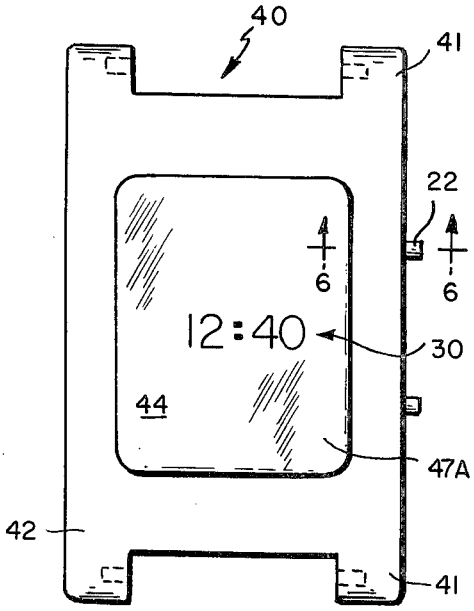
FIG. 5 is a top plan view of a second embodiment of an electronic watch embodying the invention.
Figure 6:
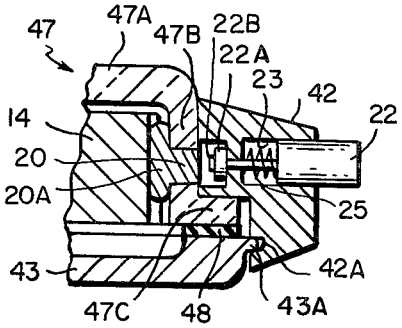
FIG. 6 is an enlarged section taken on the lines 6—6 of FIG. 5.
Figure 7:
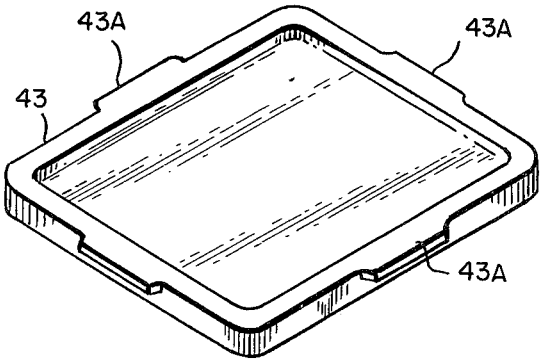
FIG. 7 is an isometric view of the back of the watch of FIG. 5.

The electronic watch shown in FIGS. 5 thru 7 of the drawings is of generally the same construction as the watch shown in FIGS. 1 thru 4 of the drawings except that the crystal and the back are generally rectangular in shape and the back is detachably secured to the bezel by a snap fit rather than by screw threads.

The electronic watch 40 shown in FIG. 5 comprises lugs 41 to receive the ends of a watch band.

The back 43, crystal 44 and gasket 48 are each of a generally rectangular shape.

The crystal has an upper member 47A, the lower surface of which is adjacent to the upper surface of the module 14. Its first flange 47B extends downwardly adjacent to the sides of the module and its second flange 47C extends outwardly from the bottom of the first flange.

The back 43 comprises relatively thin outwardly extending members which are snapped into the recesses 42 of the bezel to detachably secure the back to the bezel and thereby to hold the back against the gasket seal 48 and the gasket seal against the second flange of the crystal.

The contact means 20, 20A, plunger 22, 22A and 22B and spring 25 are of the same construction as the corresponding elements of FIGS. 1 thru 4 and they function in the same manner to close an electrically conductive path to energize a time signal.

The snap-fit construction of FIGS. 5 to 7 may be used in the generally circular watch of FIGS. 1 thru 4 instead of the screw thread means.

It will be apparent to persons skilled in the art that electronic watches embodying this invention have solved the above-described, recognized long-felt need and satisfied the above-stated objects.

While two desirable embodiments of electronic watches embodying the invention have been shown in the drawings, it is to be understood that this disclosure is for the purpose of illustration only, and that various changes in shape, proportion and arrangement of parts as well as the substitution of equivalent elements for those shown and described herein may be made without departing from the spirit and scope of the invention as set forth in the appended claims.

I claim:

1. In an electronic watch comprising:

a back, a bezel, and an electronically controlled module for digitally displaying a time signal, the improvement comprising, a crystal comprising, an upper member with its lower surface adjacent to the upper surface of said module, a first flange extending downwardly from the edge of said upper member adjacent to the side of said module, and a second flange extending laterally outwardly from the bottom of said first flange, contact means having a longitudinal portion sealed into said first flange and an inner end portion which is electrically connected to said module, a plunger mounted in a bore in said bezel, said plunger being movable along the axis of said bore, whereby the inner end portion of the plunger is engagable with the outer end of said contact means and the outer end portion of said plunger is exposed for receiving pressure by the user to cause said engagement to occur, a sealing member positioned between said second flange and an upper surface of said back, and means for holding said upper surface of said back against said sealing member and said sealing member against said second flange.

2. An electronic watch according to claim 1 wherein said sealing member comprises a gasket seal.

3. An electronic watch according to claim 1 wherein said means for holding said back against said sealing member comprises screw threads on the outer edge of the back engageable with screw threads on an inner portion of said bezel.

4. An electronic watch according to claim 1 wherein said means for holding said back against said sealing member comprises a snap fit between at least one portion on the outer edge of the back and inner portion of said bezel.

5. An electronic watch according to claim 1 wherein said means for holding said back against said sealing member comprises at least one member which extends outwardly from the outer surface of the back and the bezel comprises at least one recess for receiving the end of said outwardly extending member.

6. An electronic watch according to claim 1 wherein said means for holding said back against said sealing member comprises a plurality of spaced members extending outwardly from the outer surface of the back and the bezel comprises a plurality of recesses for receiving the ends of said outwardly extending members respectively.

* * * * *

UNITED STATES PATENT AND TRADEMARK OFFICE

CERTIFICATE OF CORRECTION

PATENT NO. : 4,120,149

DATED : October 17, 1978

INVENTOR(S) : Richard Edward Ripley

It is certified that error appears in the above-identified patent and that said Letters Patent are hereby corrected as shown below:

Col. 1, line 18, change "water" to --watch--;

Col. 3, line 8, change "righthand" to --right-hand--.

Signed and Sealed this

Sixth Day of March 1979

[SEAL]

*Attest:*

RUTH C. MASON
*Attesting Officer*

DONALD W. BANNER
*Commissioner of Patents and Trademarks*